US006187260B1

(12) United States Patent
Qin et al.

(10) Patent No.: US 6,187,260 B1
(45) Date of Patent: Feb. 13, 2001

(54) ALUMINUM METAL MATRIX COMPOSITE MATERIALS REINFORCED BY INTERMETALLIC COMPOUNDS AND ALUMINA WHISKERS

(75) Inventors: Cai-Dong Qin; Dickon Hang Leung Ng, both of Hong Kong (HK)

(73) Assignee: The Chinese University of Hong Kong (HK)

( * ) Notice: Under 35 U.S.C. 154(b), the term of this patent shall be extended for 0 days.

(21) Appl. No.: 09/305,926

(22) Filed: May 5, 1999

Related U.S. Application Data

(62) Division of application No. 08/762,814, filed on Dec. 9, 1996, now Pat. No. 5,972,523.

(51) Int. Cl.[7] ..... B22F 3/12

(52) U.S. Cl. ..... 419/45; 419/14; 419/15; 419/19; 419/38; 419/47

(58) Field of Search ..... 419/47, 19, 14, 419/15, 45, 38

(56) References Cited

U.S. PATENT DOCUMENTS 3,663,356 5/1972 Li ..... 161/225
3,890,690 6/1975 Li ..... 29/404

(List continued on next page.)

FOREIGN PATENT DOCUMENTS 502426 9/1992 (EP) .

OTHER PUBLICATIONS

"Metals Handbook, Ninth Edition, Powder Metallurgy," American Society for Metals, vol. 7, pp. II, 737, 741–743 (1984).

Dowson, "Powder Metallurgy, the process and its products," Adam Hilger publisher, pp. 114–121 (1990).

Mitra et al., "Interfaces in as–extruded XD A1/TiC and A1/$TiB_2$ metal matrix composites," J. Mater. Res., vol. 8, No. 9, pp. 2380–2392 (1993).

Mortensen et al., "Solidification processing of metal matrix composites," International Materials Reviews, vol. 37, No. 3, pp. 101–128 (1992).

Taya et al., "Metal Matrix Composites," Thermomechanical Behavior, Pergamon Press, Chapter 6, pp. 209–221 (1989).

Urquhart, "Novel reinforced ceramics and metals: a review of Lanxide's composite technologies" Materials Science and Engineering, A144 pp. 75–82 (1991).

*Primary Examiner*—Daniel J. Jenkins
(74) *Attorney, Agent, or Firm*—Townsend and Townsend and Crew LLP; Kenneth R. Allen

(57) ABSTRACT

A process for making composite materials, namely reinforced Al-metal matrix composites based on either: (I) Al—W intermetallic phase and $Al_2O_3$ ceramic whiskers, or (II) Al—Mo intermetallic phase and $Al_2O_3$ ceramic whiskers. This process involves the oxidation of aluminum using tungsten oxide in powder form for product I, and that of aluminum and molybdenum oxide in powder form for product II. Product I contains an Al—W intermetallic phase, some sapphire whiskers, and a continuous Al-metal matrix. Product II contains an Al—Mo intermetallic phase, sapphire whiskers, and a continuous Al-metal matrix. The alumina whiskers are formed as a result of two reactions. They are: (i) the oxidation between the pre-mixed Al and the oxide, and (ii) the oxidation of Al with the atmospheric environment in the presence of the oxide, which acts as a catalytic agent for the reaction. These newly invented products are hard, strong and light. They are fabricated at above the melting point of aluminum, typically above 800° C. and preferably around 1000° C., and no sophisticated facility is required in the production process. Based on the above powder mixtures of I, or II, additional powders, for example. carbon (C), silicon dioxide ($SO_2$) or other metal oxides, can be mixed to further improve the structural properties of the composites.

9 Claims, 3 Drawing Sheets

U.S. PATENT DOCUMENTS

| | | | |
|---|---|---|---|
| 3,994,428 | 11/1976 | Li | 228/18 |
| 4,152,149 | 5/1979 | Horikiri et al. | 75/138 |
| 4,232,091 | 11/1980 | Grimshaw et al. | 428/472 |
| 4,457,979 | 7/1984 | Donomoto et al. | 428/614 |
| 4,868,067 | 9/1989 | Fujisawa et al. | 428/614 |
| 4,892,693 | 1/1990 | Perrotta et al. | 264/108 |
| 4,963,439 | 10/1990 | Yamamoto et al. | 428/614 |
| 4,980,242 | 12/1990 | Yamamoto et al. | 428/614 |
| 5,286,560 | 2/1994 | Fishkis et al. | 428/357 |
| 5,421,918 | 6/1995 | Shibata | 148/431 |
| 5,449,421 | 9/1995 | Hamajima et al. | 148/415 |
| 5,460,640 * | 10/1995 | Buljan | 75/233 |
| 5,514,480 | 5/1996 | Takagi et al. | 428/549 |
| 5,541,004 | 7/1996 | Newkirk et al. | 428/539.5 |
| 5,705,280 | 1/1998 | Doty | 428/539.5 |

* cited by examiner

ALUMINUM METAL MATRIX COMPOSITE MATERIALS REINFORCED BY INTERMETALLIC COMPOUNDS AND ALUMINA WHISKERS

This application is a division of and claims the benifit of U.S. Ser. No. 08/762,814 filed Dec. 9, 1996, now U.S. Pat. No. 5,972,523, the disclosure of which is incorporated by reference.

BACKGROUND OF THE INVENTION

The present invention relates to a new type of metal matrix composite (MMC) and the process for manufacturing this new MMC. MMCs are well known structures, typically comprised of a ductile metal matrix, reinforced with ceramic fibers, whiskers, particulates, or dispersions. Most frequently, a prepared reinforcing material is mixed with molten matrix metal. Occasionally, the reinforcing structure is precipitated out of the molten phase of a melt consisting of compounds dissolved in the matrix metal.

These materials often share the best characteristics of both components of the matrix. They may combine the strength, hardness, corrosion resistance, and modulus of the reinforcement phase with the ductility, thermal and electrical conductivity, and machinability of the metal matrix phase. When aluminum is used as the matrix metal, the composite may be light, strong, and hard. This is important in many applications, specifically in machine parts, automotive and transportation parts, and electronic packaging.

Mixing a prefabricated reinforcing material with molten metal has the associated problems of inter-phase bonding, anisotropic characteristics, and non-uniform dispersion of the reinforcing structures in the matrix. Much effort has gone into solving these problems. The metal matrix does not always form a strong, cohesive bond to the reinforcing material. Methods have addressed improving both the mechanical and chemical bonding aspects, resulting in elaborately prepared starting material. For example, one technique first forms a composite of silicon carbide fibers within an alumina matrix, and then combines this composite with a metal matrix. This is done to obtain an adequate bond between the metal matrix and the silicon carbide fibers, using the alumina phase as an intermediary.

Other processes use layers or woven mats of reinforcing materials infused with molten metal. These structures have strongly anisotropic characteristics. Other fabrication techniques, such as hot or cold isostatic pressing, extrusion, and arc/drum spraying can also result in isotropic characteristics, depending on the type of reinforcing material. This results in a non-uniform material, which is undesirable in many applications.

Even without using processes that result in inherently anisotropic materials, uniform dispersion of the reinforcing phase within the matrix may result in a non-uniform material. For example, dispersed reinforcing particles may settle. One method that addresses this problem pounds the reinforcing phase into a powder of the metal, and then forms the finished part by sintering, which is a solid-phase process. Many other methods pre-form the reinforcing material into a near-finished shape and infuse it with molten matrix metal. However, obtaining a uniform infusion is difficult, as is obtaining a uniform bond between the matrix and the reinforcement phase, as discussed above.

The performance of the material is known to depend on its macroscopic mechanical properties, which must be uniform to achieve the uniform benefit of the composite. Moreover, a metal matrix that is not strongly bonded to the reinforcing phase does not gain the full value of the reinforcement. Finally, exotic, difficult, or complicated fabrication processes of either the composite or its precursor materials make the use of those composites economically unattractive, if not unfeasible. What is needed is a feasible and economically viable composite and method of fabrication.

SUMMARY OF THE INVENTION

According to the invention, a reinforced metal matrix composite (MMC) is composed of an aluminum-based matrix (such as an aluminum alloy matrix) formed concurrently with the formation of sapphire whiskers, such that the sapphire whiskers are distributed randomly and uniformly within the matrix. (Sapphire is a single-crystal form of aluminum oxide). The composite is composed of a mixture of aluminum-based metal powder and a metal oxide powder that acts as an oxidizing agent to aluminum, such as tungsten or molybdenum, so that the oxygen is transferred from the metal oxide powder to the aluminum during the formation of the composite. Alternatively, the MMC is an aluminum-based matrix formed concurrently with a combination of the formation of sapphire whiskers and refractory metal intermetallics, such as aluminum molybdenide (Al—Mo) or aluminum tungstide (Al—W), the intermetallics being harder than the aluminum matrix. This formation yields a product wherein the sapphire whiskers are randomly oriented and evenly distributed throughout the matrix, and wherein the amount of the intermetallic phase is controllable.

FIG. 1 is a partial phase diagram for the aluminum-tungsten binary system. Although the present invention typically has three components, aluminum, alumina (sapphire), and the intermetallic, the binary phase diagram approximates the interaction between aluminum and the refractory metal. FIG. 1 shows that with even small amounts (less than 2 weight %) of available tungsten, intermetallic phases form above the melting point of aluminum. FIG. 2 is a partial phase diagram for the aluminum-molybdenum binary system. Similarly, various intermetallic phases are shown above the melting point of aluminum at low weight percents of molybdenum.

Further according to the invention is a method for producing this MMC utilizing aluminum powder mixed with refractory metal oxide powder, wherein the powders are mixed and fired at a temperature sufficient to melt the aluminum and to cause the metal oxide powder to strengthen the resulting composite by forming sapphire whiskers and intermetallic phases.

It is believed the refractory metal oxide powder contributes to the strengthening of the aluminum matrix in at least three ways. First, the metal oxide is reduced, providing oxygen to oxidize the aluminum in the matrix, forming sapphire, which grows into whiskers. Second, the oxide acts as a catalyst, allowing ambient oxygen in the firing atmosphere to combine with the aluminum, further forming sapphire whiskers. Third the reduced metal oxide provides metal atoms to combine with the aluminum to form an intermetallic phase, further strengthening and hardening the matrix.

In one embodiment, the fabrication process involves the powder mixing of $WO_3$ or $MoO_3$ with the Al metal in powder form. The mixture is then pressed and fired at a temperature of at least 660° C. and less than about 1100° C., preferably about 1000° C., in either vacuum, air or oxygen. The reinforcement phases are formed in situ from the reactions of the oxide powders with the aluminum, resulting in low cost production of the MMC. This low cost is achieved both by the simplicity of the fabrication process and also because oxide powders are used, which are inexpensive compared to the associated metal powders.

Because the sapphire whiskers are formed in situ, they are inherently uniformly distributed within the matrix (assuming a uniform temperature across the work space). Sapphire whiskers of approximately 20 $\mu$m in length and approximately 2 $\mu$m in diameter were formed. Compared to a conventional aluminum-based matrix, these whiskers within the matrix improve fracture toughness in all directions of the structure because, even though the sapphire whiskers are themselves highly anisotropic regarding modulus and strength, the orientation of the whiskers is random within the matrix.

Additional reinforcement phases also result from this process. For example, interrnetallic phases of W—Al and Al—Mo have been produced in situ. The phases are evenly distributed in the resultant Al metal matrix, thus further enhancing the hardness and the general mechanical properties of the composite. The relative amounts of these intermetallic and ceramic phases vary according to the powder compact compositions, and whether the compositions are fired in air, oxygen or vacuum.

The invention will be better understood with reference to the drawings and detailed description which follows.

DESCRIPTION OF SPECIFIC EMBODIMENTS

Figure 1:
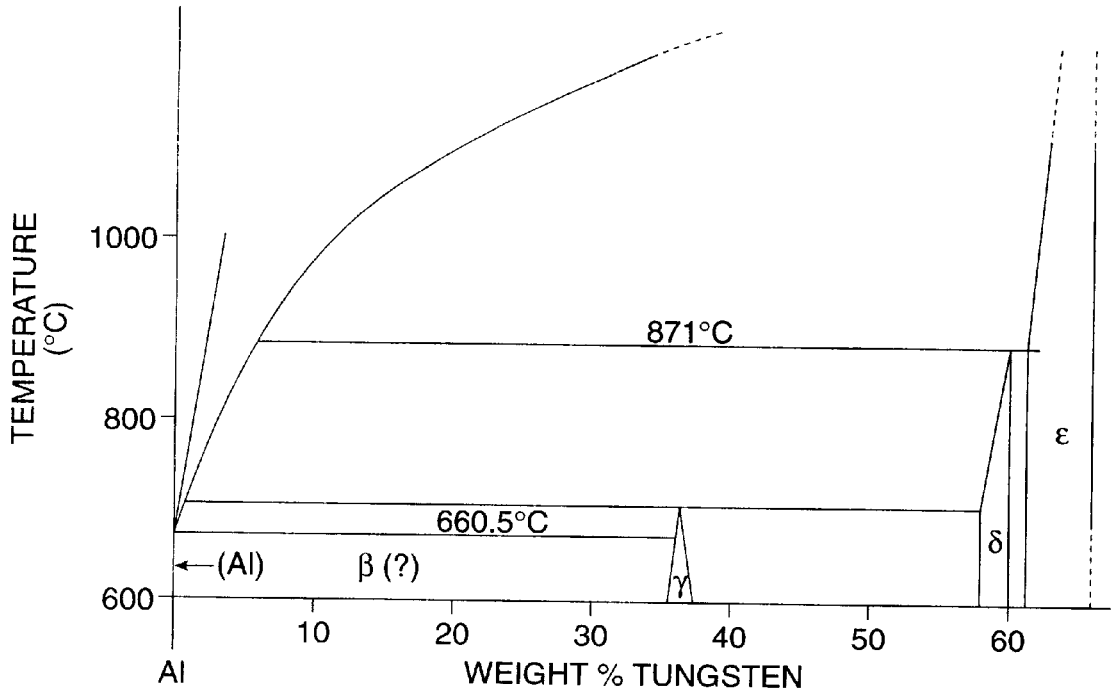
FIG. 1 (PRIOR ART)
FIG. 1 shows the tungsten-aluminum phase diagram.
Figure 2:
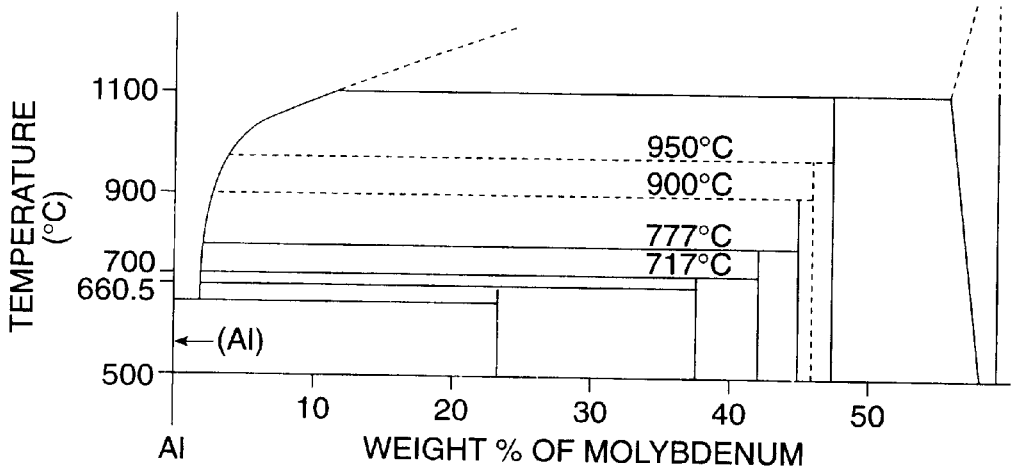
FIG. 2 (PRIOR ART)
FIG. 2 shows the molybdenum-aluminum phase diagram.

The invention focuses on reinforced metal matrix composites (MMC) composed of an aluminum-based matrix (such as an aluminum alloy matrix) formed concurrently with the formation of sapphire whiskers, alone or in combination with other reinforcing material. In one embodiment. aluminum or aluminum alloy is used for the matrix because it is light, strong, and forms a strong oxide. Because chemical bonding between aluminum oxide (alumina) and aluminum is inherently strong, it allows the aluminum matrix to obtain the benefit of the alumina reinforcing phase. The alumina reinforcing phase is in the form of sapphire (single-crystal alumina) whiskers, which are relatively strong, tough and hard.

The sapphire whiskers result from the reduction-oxidation reaction occurring in situ between aluminum and an oxide according to the reaction:

$$RO_3+2Al \rightarrow Al_2O_3+R \quad (1)$$

where R is a refractory metal, such as tungsten (W) or molybdenum (Mo). The reduced oxide provides a metal atom for the formation of an intermetallic phase according to the reaction:

$$R+3Al \rightarrow RAl_3 \quad (2)$$

These products form in vacuum (about iO-$^6$mbar) when mixed aluminum and R-oxide powders are fired at between 800 and 1100° C. for a period of about one hour. Alternatively, the powders may be fired in air or oxygen. Because aluminum melts at about 660° C., the reactions involving aluminum take place with aluminum in the liquid phase.

When fired in air or oxygen, it is believed the R-oxide also acts as a catalyst for the formation of alumina/sapphire from the aluminum and ambient oxygen. The presence of more R-oxide can therefore result in an increase of the alumina formed, and an increase in the weight of the sample after firing due to the incorporation of this atmospheric oxygen.

Another embodiment of the invention incorporates carbon (C) into the mixture of the aluminum and oxide powders. In one specific experiment, carbon was added to lubricate the powder mixture and improve its pressing and molding characteristics. When a firing treatment was applied to a sample which contained carbon powder, carbide compounds $Al_4C_3$ and WC form in addition to the formation of the intermetallic $WAl_3$. As these reaction products are hard materials, the hardness in the samples which contain C are relatively higher than in the samples that do not. There was a slight loss of weight in the carbon-containing samples due to the formation of carbon dioxide, which escapes as a gas. The reactions occurring when carbon powder was added into the aluminum/oxide powder mixture can be described by equations (1) and (2), and by the following equations:

$$4Al+3C \rightarrow Al_4C_3 \quad (3)$$

$$R+C \rightarrow RC \quad (4)$$

When the samples, with and without the addition of carbon, were fired in air, they contained more $Al_2O_3$ whiskers than those fired in vacuum. These alumina whiskers were about 2 $\mu$m in diameter and about 20 $\mu$m in length. The intermetallic phases had a diameter and a length up to 20 $\mu$m and 200 $\mu$m respectively. The relative amounts of these intermetallic and ceramic phases vary according to powder compact compositions. Generally, using more oxide in the powder mixture resulted in more intermetallic phase being formed. The reactions which occurred can be summarized by the following equations:

$$RO_3+2Al \rightarrow Al_2O_3+R \quad (5)$$

$$2R+3O_2 \rightarrow 2RO_3 \quad (6)$$

$$R+3Al \rightarrow RAl_3 \quad (7)$$

$$4Al+3O_2 \rightarrow 2Al_2O_3 \quad (8)$$

It should be noted that other refractory metal oxide powder or powders may be mixed with aluminum powder in this process to obtain the resultant, desired MMC. Those familiar with the art will appreciate that several different oxide powders may be mixed with aluminum or aluminum alloy powder, and that the process and resultant material is not limited to using a single oxide powder. Tungsten and molybdenum oxides are used here only as examples, and not as limitations.

TABLE 1

Contents of powders in the preparation of samples, designated as sample composition no. 1 to 9:

| Sample Composition No. | $WO_3$ (wt %) | Al (wt %) | C (wt %) | $SiO_2$ (wt %) |
|---|---|---|---|---|
| 1 | 5.4 | balance | 0 | 0 |
| 2 | 8.4 | balance | 0 | 0 |

TABLE 1-continued

Contents of powders in the preparation of samples, designated as sample composition no. 1 to 9:

| Sample Composition No. | $WO_3$ (wt %) | Al (wt %) | C (wt %) | $SiO_2$ (wt %) |
|---|---|---|---|---|
| 3 | 16.2 | balance | 0 | 0 |
| 4 | 34.3 | balance | 0 | 0 |
| 5 | 52.5 | balance | 0 | 0 |
| 6 | 13.0 | balance | 3.0 | 0 |
| 7 | 26.5 | balance | 3.4 | 0 |
| 8 | 26.5 | balance | 3.3 | 7.8 |
| | $MoO_3$ (wt %) | | | |
| 9 | 10.8 | balance | 0.7 | 0 |

The well-mixed fine $WO_3$/Al powder and $MoO_3$/Al powder were cold pressed under a pressure of 200 MPa to form discs of 10 mm diameter and 3.5 mm thickness. Some of these samples were fired at 900° C. for 1 hour in a low pressure of $10^{-6}$ mbar, while others were either fired at 800, 1000 or 1100° C. in air for 1 hour.

Characterization of the MMC Materials

Figure 3:
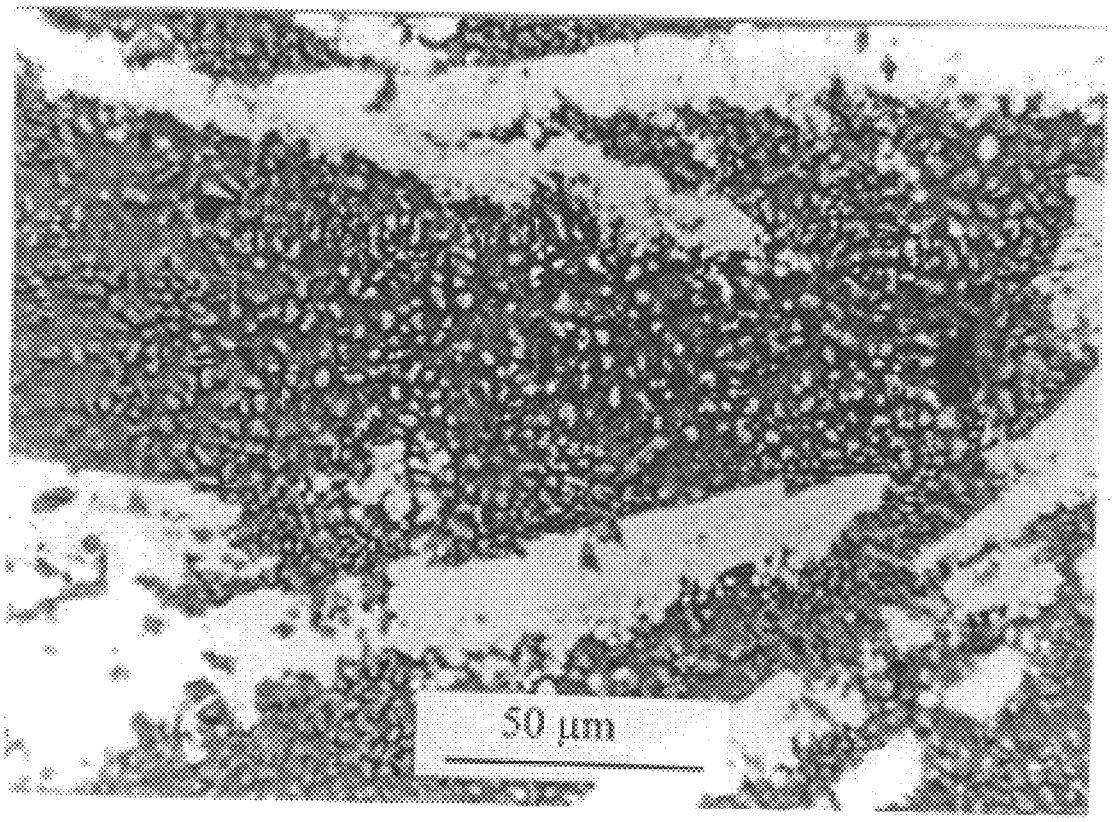
FIG. 3 is a scanning electron micrograph of a typical microstructure of a composite material made by the process according to one embodiment of the invention.
Figure 4:
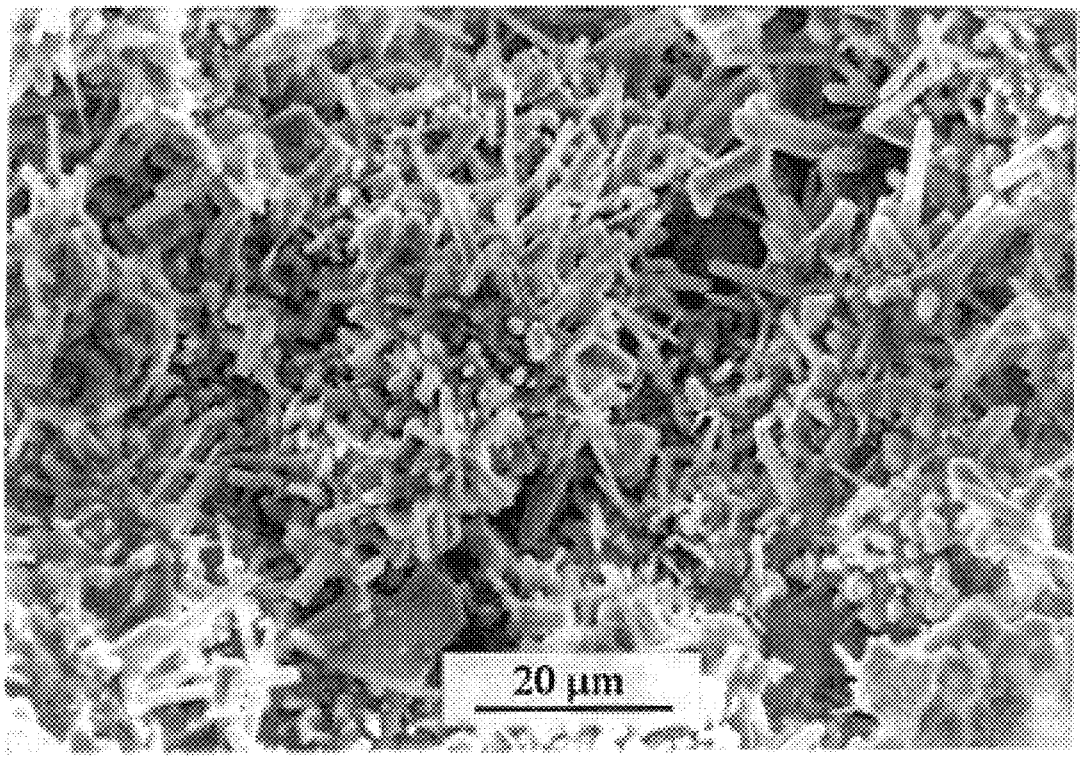
FIG. 4 is a scanning electron micrograph of the material of FIG. 3 after etching in sodium hydroxide (NaOH) wherein some of the Al matrix has been leached away, exposing the $Al_2O_3$ whiskers.

FIGS. 3 and 4 illustrate the microstructure of the Al—$WO_3$ MMC. Using $MoO_3$ instead of $WO_3$ produces similar results (not shown). FIG. 3 shows an SEM of a powder mixture of $WO_3$ and Al, fired at 1,100° C. for 1 hour in air. The bright stripe-like patches are the intermetallic $WAl_3$, and the smaller spots are the tips of the $Al_2O_3$ whiskers embedded in the darker Al metal matrix. FIG. 4 shows, at a higher magnification, the results after etching the material of FIG. 3 in sodium hydroxide (NaOH) wherein some of the Al matrix has been leached away, exposing the $Al_2O_3$ whiskers. The hardness tests of the prepared samples were performed on the region reinforced by the $Al_2O_3$ whiskers with a Vickers indentor. The results of these tests are shown in Table 2. Some of these samples were also tensile-tested and compression-tested with an Instron machine. The results, together with some other commercial powder metallurgy (P/M) samples, listed for comparison, are shown in Table 3.

For the tensile tests, large samples, 5 mm thick and 100 mm in diameter, were fabricated using the same sintering method described above. These samples were cut into small bars for the tensile stress-strain measurements on the Instron machine.

TABLE 2

Some properties of the fabricated MMCs
d = density, g = weight gain and $H_v$ = Vicers microhardness number.

| | In vac. at 900° C. | | | In air at 1000° C. | | | In air at 1100° C. | | |
|---|---|---|---|---|---|---|---|---|---|
| Sample No. | d ($g/cm^3$) | $H_v$ ($kg/mm^2$) | g (%) | d ($g/cm^3$) | $H_v$ ($kg/mm^2$) | g (%) | d ($g/cm^3$) | $H_v$ ($kg/mm^2$) | g (%) |
| 1 | | | 0 | 2.25 | 40 | 4.1 | 2.71 | 47 | 4.9 |
| 2 | | | 0 | 2.30 | 46 | 4.2 | 2.75 | 48 | 4.9 |
| 3 | | | 0 | 2.67 | 48 | 4.8 | 2.90 | 50 | 7.2 |
| 4 | 2.71 | 48 | 0 | 2.70 | 56 | 4.9 | 3.24 | 59 | 9.0 |
| 5 | | | 0 | 3.32 | 119 | 17.7 | 3.63 | 129 | 17.8 |
| 6 | 2.53 | 80 | −0.8 | 2.98 | 80 | 3.2 | 2.88 | 65 | 3.5 |
| 7 | 2.81 | 85 | −0.2 | 2.96 | 100 | 3.7 | 2.98 | 70 | 4.1 |
| 8 | | | | 2.40 | 100 | 9.98 | 2.36 | 100 | 9.8 |
| 9 | | | | 2.96 | 60 | 4.0 | | | |

TABLE 3

Tensile and compressive test results of some of the fabricated metal matrix composites

| Tensile Test results | Yield strength (MPa) | Tensile strength (MPa) | Elongation % | Density g/cc |
|---|---|---|---|---|
| Al - 20 wt % $WO_3$ - 1 wt % C | 134 | 180 | 2 | 3.3 |
| Sintered Al powder*1 | 25 | 56 | 6 | 2.64 |
| P/M Al alloy sintered in $N_2$: Al - 0.25 wt % Cu - 0.6 wt % Si - 1 wt % Mg*2 (grade 601AB) | 48–230 | 110–238 | 1–6 | |
| P/M Al alloy sintered in $N_2$: Al - 4.4 wt % CU - 0.8 wt % Si - 0.5 wt % Mg*2 (grade 201AB) | 145–327 | 169–332 | 3 | |
| Sintered 10 wt % Sn bronze*2 | | 96–138 | 1–3 | 6.4–7.2 |
| Sintered 20 wt % Sn bronze*2 | | 136–255 | 10–21 | 7.2–8.0 |
| **Compressive Test Results** | **Yield point in compression (MPa)** | | | |
| Al - 20 wt % $WO_3$ - 1 wt % C | 220 | | | 3.3 |
| Al - 10 wt % $MoO_3$ - 1 wt % C | 140 | | | 2.83 |
| Sintered Al powder sample *1 | 80 | | | 2.7 |

TABLE 3-continued

Tensile and compressive test results of some of the fabricated metal matrix composites

| | | Tensile strength (MPa) | Elongation % | Density g/cc |
|---|---|---|---|---|
| Sintered bronze parts: Cu with 9.5–10.5 wt % $Sn_2$ 1.75 wt % C, and 1.0 wt % Fe*3 | 76–138 | | | 6.4–7.2 |

*1Prepared samples.
*2Metals Handbook, 9th Edition, Vol. 7, Powder Metallurgy, American Soc. for Metals, p. 743 (1984).
*3Metals Handbook, 9th Edition, Vol. 7, Powder Metallurgy, American Soc. for Metals, p. 737 (1984).

In general the density of these samples is very close to that of the pure Al (around 3 gm/cm$^3$). The Vickers hardness number of pure Al metal is usually around 30–60 (kg/mm$^2$). The measured Vickers hardness numbers for the W—Al intermetallic phases varies from 600 to 800 (kg/mm$^2$), and that of the Mo—Al intermetallic phase is about 680 (kg/mm$^2$). While the hardness values of the area which contains the fine alumina whiskers is lower, as listed in Table 2. The average macrohardness of the Al-metal matrix composite is in the range of 300 to 600 (kg/mm$^2$).

With regard to the volume percentage of the alumina ($Al_2O_3$) whiskers and the intermetallic compound, it is estimated that they are in the range of 5 to 30 vol. %, and 2 to 10 vol. % respectively. These values largely depend on the amount of the oxides in the powder mixture.

To summarize, some types of metal matrix composite materials can be produced by firing compacted powder mixtures of tungsten oxide or molybdenum oxide with aluminum. The products are generally tough but light. They are also simple and economical to fabricate, and use relatively inexpensive starting materials. These composites can be further processed by forging and repeated firing to improve their properties. If the powder of an aluminum alloy is used instead of aluminum powder. the resultant continuous matrix phase of the MMC would be an aluminum alloy, such matrix again is reinforced by the alumina whiskers and the W—Al (or Mo—Al) intermetallic phase. An aluminum alloy matrix may provide additional strengthening compared to an aluminum matrix due to precipitation hardening or other dispersive strengthening agents.

While the above is a complete description of specific embodiments of the present invention, various modifications, variations and alternatives may be employed. The scope of this invention, therefore, should not be limited to the embodiments described, and should instead be defined by the following claims.

What is claimed is:

1. A process for forming a metal matrix composite, the process comprising the steps of:

(a) mixing a metal powder and a refractory metal oxide powder to form a powder mixture, said metal powder comprising aluminum and said powder mixture having a weight percent of said metal powder between about 47–95;

(b) molding said powder mixture under pressure to form a shape; and (c) firing said shape at a temperature between about 660–1100° C. wherein said refractory metal oxide powder reacts with said metal powder to form a reinforcing phase in a metal matrix.

2. The process according to claim 1 wherein said firing step is performed at a temperature between about 800–1100° C. for a firing period of about one hour.

3. The process of claim 1 wherein said mixing step (a) further comprises mixing a carbon-containing powder with said metal powder and said refractory metal oxide powder to form said powder mixture, said powder mixture containing a weight percent of said carbon-containing powder of about 3, said carbon-containing powder reacting during the firing step to form a hardening phase.

4. The process of claim 1 wherein said firing is done in an atmosphere containing oxygen.

5. The process of claim 1 wherein said firing is done in a vacuum.

6. The process of claim 1 wherein said mixing step (a) further comprises mixing a silicon oxide powder with said metal powder and said refractory metal oxide powder to form said powder mixture.

7. The process of claim 6 wherein mixing step (a) further comprises mixing a finely-divided carbon-containing compound with said metal powder and said silicon oxide powder to form said powder mixture.

8. A process for forming a reinforced metal matrix composite, the process comprising the steps of:

(a) mixing a metal powder and a ceramic powder together to form a powder mixture, said metal powder comprising aluminum and said ceramic powder comprising tungsten oxide or molybdenum oxide;

(b) forming said powder mixture into a stable shape by applying pressure; and (c) firing said stable shape powder mixture at a temperature above the melting point of the metal 660° C.

9. A process for forming a reinforced metal matrix composite, the process comprising the steps of:

(a) mixing a metal powder and a refractory metal oxide powder together to form a powder mixture containing at least about 47 weight percent of the metal powder, said metal powder comprising aluminum and said refractory metal oxide powder comprising tungsten oxide or molybdenum oxide;

(b) forming said powder mixture into a stable shape by applying pressure;

(c) firing said stable shape powder mixture at a temperature between about 660–1100° C. to form a reinforcing phase in a metal matrix.

* * * * *